US006217370B1

(12) United States Patent
Scheel et al.

(10) Patent No.: US 6,217,370 B1
(45) **Date of Patent: *Apr. 17, 2001**

(54) CIRCUIT BREAKER ACCESSORY MODULE TERMINAL PLUG

(75) Inventors: Jerry Lynn Scheel; Randy Luther Siebels, both of Cedar Rapids, IA (US); Scott Manfred Peterson, St. Michaels, MD (US)

(73) Assignee: Square D Company, Palatine, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/629,662

(22) Filed: Apr. 9, 1996

(51) Int. Cl.[7] ..... H01R 13/00
(52) U.S. Cl. ..... 439/483
(58) Field of Search ..... 439/476.1, 483, 439/484, 709, 810, 813, 814

(56) References Cited

U.S. PATENT DOCUMENTS

| | | | | |
|---|---|---|---|---|
| 4,623,859 | | 11/1986 | Erickson et al. . | |
| 4,794,356 | | 12/1988 | Yu et al. . | |
| 4,796,844 | | 1/1989 | Barker . | |
| 4,831,221 | | 5/1989 | Yu et al. . | |
| 4,864,263 | | 9/1989 | Castonguay et al. . | |
| 4,881,911 | * | 11/1989 | Haddock et al. | 439/484 |
| 4,912,439 | | 3/1990 | Nagy et al. . | |
| 5,003,139 | | 3/1991 | Edds et al. . | |
| 5,083,103 | | 1/1992 | Winter et al. . | |
| 5,140,115 | | 8/1992 | Morris et al. . | |
| 5,172,088 | | 12/1992 | Morgan . | |
| 5,180,051 | | 1/1993 | Cook et al. . | |
| 5,194,015 | * | 3/1993 | Yamamoto et al. | 439/484 |
| 5,252,937 | | 10/1993 | Bernier et al. . | |
| 5,253,140 | * | 10/1993 | Inoue et al. | 361/728 |
| 5,272,591 | | 12/1993 | Blue et al. . | |
| 5,272,592 | | 12/1993 | Harris et al. . | |
| 5,301,083 | | 4/1994 | Grass et al. . | |
| 5,404,266 | | 4/1995 | Orchard et al. . | |
| 5,418,683 | | 5/1995 | Orchard . | |
| 5,430,419 | | 7/1995 | Scheel et al. . | |

* cited by examiner

*Primary Examiner*—Khiem Nguyen
(74) *Attorney, Agent, or Firm*—Kareem M. Irfan; Larry I. Golden

(57) ABSTRACT

The present invention provides an accessory module for monitoring and controlling the status of a circuit breaker. The accessory module attaches to the side of a circuit breaker and has a mechanism similar to the mechanism in a circuit breaker. The mechanism has multiple positions that correspond to multiple states of a circuit breaker. Actuators transform relatively large-scale motions of the mechanism into small-scale motions and transfers these to buttons on switches. Depressing these switches depending on the position of the mechanical assembly makes and breaks circuits that are in communication with a remote site. The invention provides a circuit board designed specifically to hold and locate the switches and actuators and provide tracings that can withstand high currents. The invention further provides a terminal plug having a pull tab which can be grasped to remove an otherwise inaccessible terminal plug. The invention further provides a dual-function base, which serves both as an enclosure and as a spacer.

9 Claims, 7 Drawing Sheets

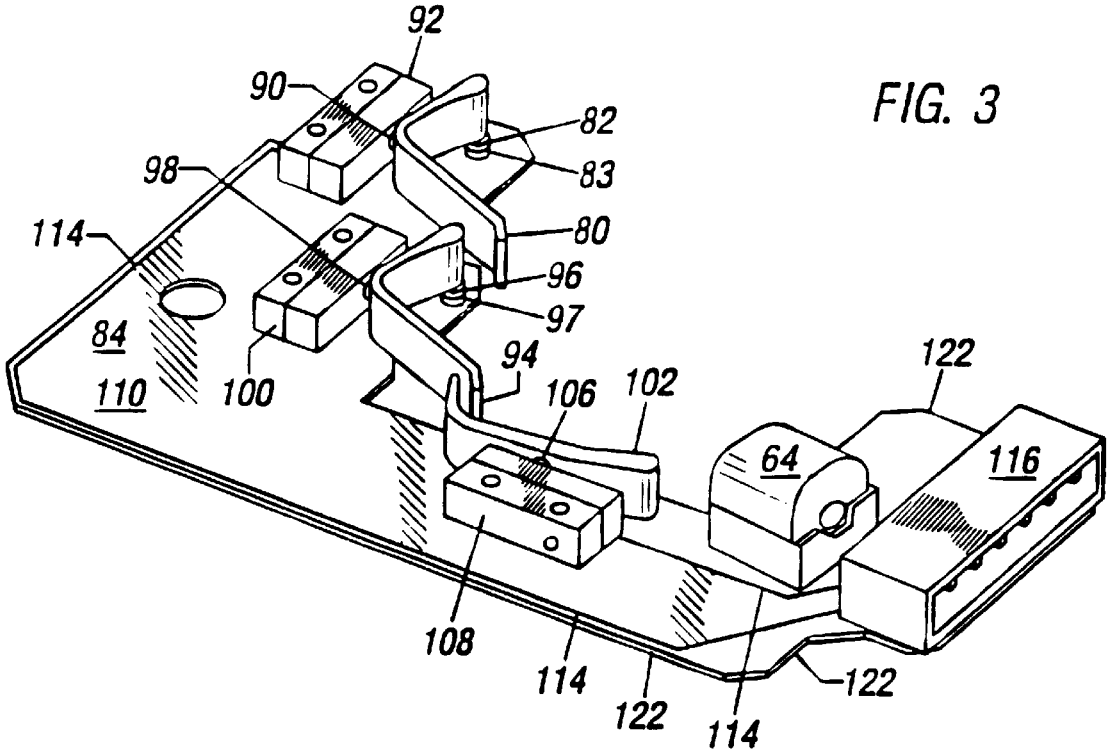
FIG. 3
FIG. 4
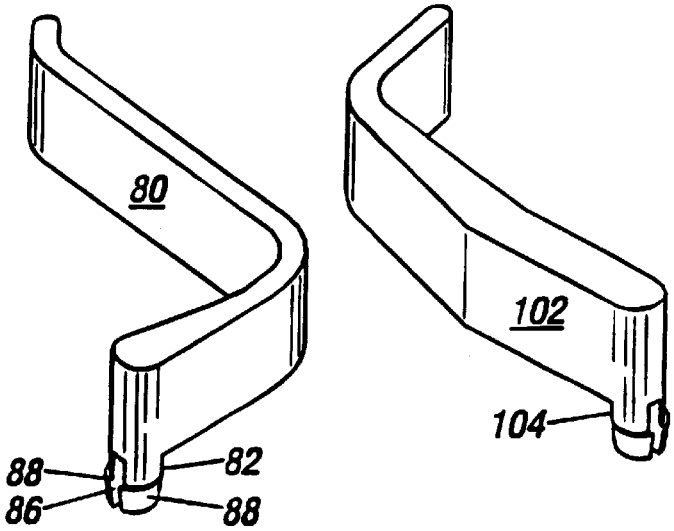

CIRCUIT BREAKER ACCESSORY MODULE TERMINAL PLUG

BACKGROUND OF THE INVENTION

1. Field of the Invention

This invention relates generally to electric circuit breakers and more particularly to the indication of the status of a circuit breaker and the remote control of a circuit breaker.

2. Description of the Related Art

Circuit breakers are commonly used for temporary interruption of electrical power to electrically powered devices. Various circuit breaker mechanisms have evolved and have been perfected over time on the basis of application-specific factors such as current capacity, response time, and the type of reset (manual or remote) function desired of the breaker.

One type of circuit breaker mechanism employs a thermomagnetic tripping device to trip a latch in response to a specific range of over-current conditions. In another type of circuit breaker, referred to as a double-break circuit breaker, two sets of current breaking contacts are included to accommodate a higher level of over-current conditions than can be handled by one set of contacts. U.S. Pat. No. 5,430,419 describes a typical mechanical and electrical assembly that is utilized in circuit breakers according to the present invention and is incorporated herein by reference in its entirety.

A circuit breaker has typically three possible statuses: off, where the contacts are open; on, where the contacts are closed for completing a circuit path; and tripped, where the contacts are open because of an abnormal condition. It is desirable to monitor and control a circuit breaker's status from a remote location, such as in a control center. Systems are known, such as disclosed in U.S. Pat. No. 4,794,356, which provide in the form of a modular accessory a position-indicating switch coupled directly to the movement of an electrical circuit breaker contacter. The systems provide sensing conditions indicative of the contact condition of the circuit breaker and can indicate whether the contacts have become fused together.

U.S. Pat. No. 4,794,356 describes a combined trip actuator mechanism and accessory unit for articulating the circuit breaker operating mechanism and interfacing with the accessory unit for remote trip as well as trip indication function. U.S. Pat. Nos. 4,831,221 and 4,912,439 describe auxiliary switch accessories used within industrial-grade circuit breakers. The auxiliary switch accessories interact with the circuit breaker operating mechanism to provide remote indication of the condition of the circuit breaker contacts. U.S. Pat. No. 4,864,263 describes a crossbar unit that carries the movable contact arm and provides an accurate indication as to the actual condition of the contacts. In some instances the auxiliary switch accessory unit operates directly off the circuit breaker operating mechanism crossbar unit to provide an indication of the status of the circuit breaker.

U.S. Pat. No. 5,003,139 describes a circuit breaker housing modified to provide an access passage exposing a portion of the circuit breaker blade mechanism to external access and a bolt-on accessory module containing a rotor coupled to a movable coupling member configured to extend through the circuit breaker passage to engage a portion of the blade mechanism. A member carried with the blade mechanism mounted on a trip arm carried with the blade extends toward the passage to engage with the coupling member. A sensing switch is engaged by a camming surface on the rotor so that the rotor will be moved responsively to tripping and resetting of the circuit breaker blade to indicate the true position of the circuit breaker contacts. Rotation of the rotor will trip the circuit breaker when the circuit breaker is in the reset position. A solenoid is provided to engagingly rotate the rotor in the tripping direction. A single coupling element senses the state of the circuit breaker and provides means for remotely tripping it.

In general, the present invention pertains to monitoring and control of a circuit breaker from a remote location. Although devices exist for this general purpose, it is believed that a need exists for a circuit breaker accessory module capable of sensing the position of components in the circuit breaker and capable of initiating a change in the status of a circuit breaker. Such an accessory module is preferably reliable and durable and preferably incorporates advances in circuit board and switch technology when such advances improve the accessory module. Practical concerns regarding field installation are preferably addressed, and parts are preferably interchangeable so as to minimize the number of parts required.

SUMMARY OF THE INVENTION

The present invention provides a device for use with a circuit breaker having at least two positions therein that indicate different statuses of the circuit breaker. The device comprises an apparatus coupled to the circuit breaker for detecting the status of the circuit breaker, a status indicator having a separate state that corresponds to each of the statuses detected by the apparatus, and an actuator associated with the apparatus and the status indicator for communicating the status detected by the apparatus to the status indicator.

In another aspect the present invention provides an accessory module for a circuit breaker. The accessory module comprises a base, a mechanism in the base, the mechanism having at least two positions, a circuit board in the base, a position indicator mounted on the circuit board, and an actuator for communicating the position of the mechanism to the position indicator. Preferably, the accessory module further comprises a connector mounted on the board. The accessory module may include a terminal plug engaged with the connector. Preferably the actuator has a pivot, and the circuit board may have a hole for receiving the pivot.

In another aspect the invention provides a method for indicating the status of a circuit breaker. The method comprises coupling a mechanism to the circuit breaker, positioning the mechanism in different positions, each position corresponding to a status of the circuit breaker, detecting the position of the mechanism, and indicating the detected position. Preferably the method further comprises sending the indicated position to a remote location.

In another aspect the invention provides a printed circuit board for an accessory module for a circuit breaker, wherein the circuit breaker has a status. The printed circuit board comprising a board and a status indicator mounted on the board for indicating the status of the circuit breaker. Preferably, the status indicator is a switch. In a preferred embodiment the circuit board has a hole for receiving a pivot of an actuator cooperating with a switch on the circuit board.

In another aspect the invention provides an actuator for an accessory module for a circuit breaker, wherein the circuit breaker has a status. The actuator communicates the status of the circuit breaker and has a body. The body has a shape of a generally rectangular plate with at least one bend, first and second ends, and a pivot proximate to the first end.

In another aspect the invention provides a terminal plug having a pull tab, and a pull tab for a terminal plug so that an inaccessible plug can be removed from a connector. Preferably, a pull tab comprises a flexible sheet having adhesive on one side and a paper covering the adhesive. A pull tab is preferably secured to a terminal plug during assembly and preferably extends from an enclosure housing the terminal plug.

In another aspect the invention provides a dual-function base for holding and enclosing components of an accessory module attached to a circuit breaker and for spacing. The base has an inside surface for receiving components of an accessory module and for connection to an inside surface of a cover for enclosing the components, and an outside surface for connection to the circuit breaker, wherein the outside surface of the base is designed to also matingly engage an outside surface of the cover so that a second base can be used as a spacer.

BRIEF DESCRIPTION OF THE DRAWINGS

For a detailed understanding of the present invention, references should be made to the following detailed description of the preferred embodiment, taken in conjunction with the accompanying drawings, in which like elements have been given like numerals and wherein:

FIG. 3 shows an isometric view of the top side of a circuit board, switches, and actuators according to the present invention.

FIG. 4 shows the actuators of the present invention.

DETAILED DESCRIPTION OF THE PREFERRED EMBODIMENTS

An accessory module is attached to the side of a circuit breaker, and as will be discussed in more detail below, the accessory module has a mechanism for interacting with a circuit breaker. The mechanism can both detect the status of a circuit breaker and change that status, based on input from an outside source, i.e. a signal. In general, the accessory module completes certain circuits based on the status of the circuit breaker and thus serves as an indicator. Such indications can be sent to a remote site by electronic signals. On the other hand the accessory module can receive electronic signals from a remote site and change the status of a circuit breaker based on those signals. The mechanism cooperates with a printed circuit board having switches to perform various functions. Actuators transmit the mechanical motion of the mechanism to the switches. A coil and associated circuitry transform an electronic signal into mechanical motion of the mechanism in the accessory module, which is in turn transmitted to the circuit breaker.

In general, the mechanism used in the accessory module is a part-for-part duplication of the mechanism used in a circuit breaker. The design of the mechanism reflects a method of relaying the position of specific parts to a set of switch actuators that initiate circuit opening or closing based on the relationship between part position and circuit breaker condition. The accessory mechanism is controlled by handle keys and crossbars in a similar manner as control and/or manipulation is performed between circuit breaker poles. By using the same combination of crossbars, handle keys, and mechanisms between the circuit breaker and the accessory module as is used between poles in a circuit breaker, an accessory module is created that performs with the excellence expected of a circuit breaker.

Shunt tripping energizes a coil that is linked to an accessory armature, which delatches a trip lever conveying that information to an adjoining circuit breaker via action of a crossbar. A bell alarm or alarm switch activates when the trip lever in the accessory module is delatched by shunt tripping or by rotation of the crossbar. A clearing switch provides an energy drain for the shunt. Contacts in the clearing switch are normally closed and open after the coil is energized. When the coil is energized, the trip lever is delatched, which changes the status of the clearing switch. An activation switch for the accessory module itself is switched by a blade position, which is controlled by the switch handle position of the associated circuit breaker. A shunt trip circuit is activated when the circuit breaker switch handle is in the "on" position and deactivated when the handle is in the "off" position. The mechanism in the accessory module has its own stored energy for initiating the required mechanical motion. Energy is stored in a spring during assembly of the mechanism.

Figure 1:
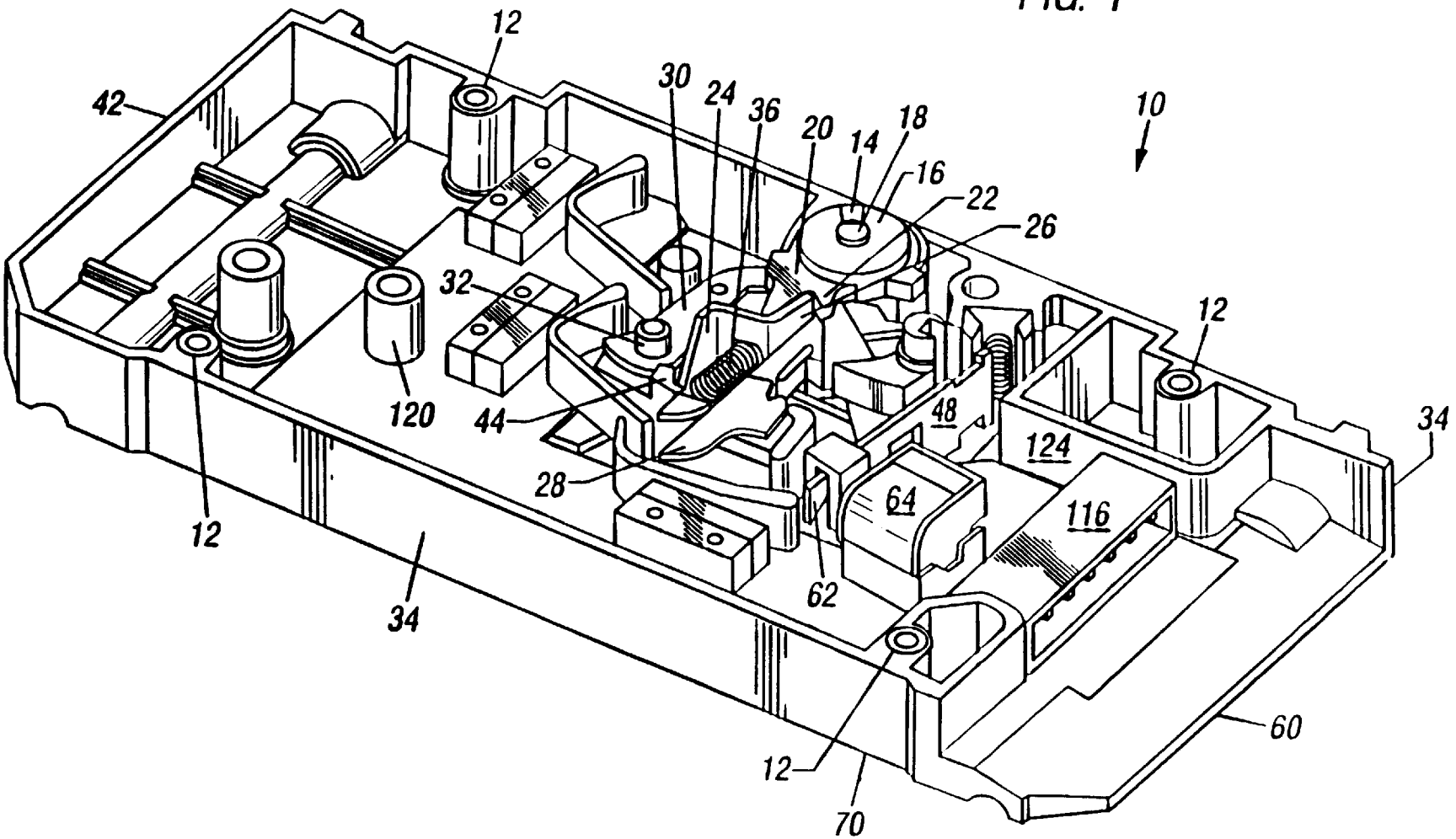
FIG. 1 shows an isometric view of an accessory module of the present invention without its cover.
Figure 2:
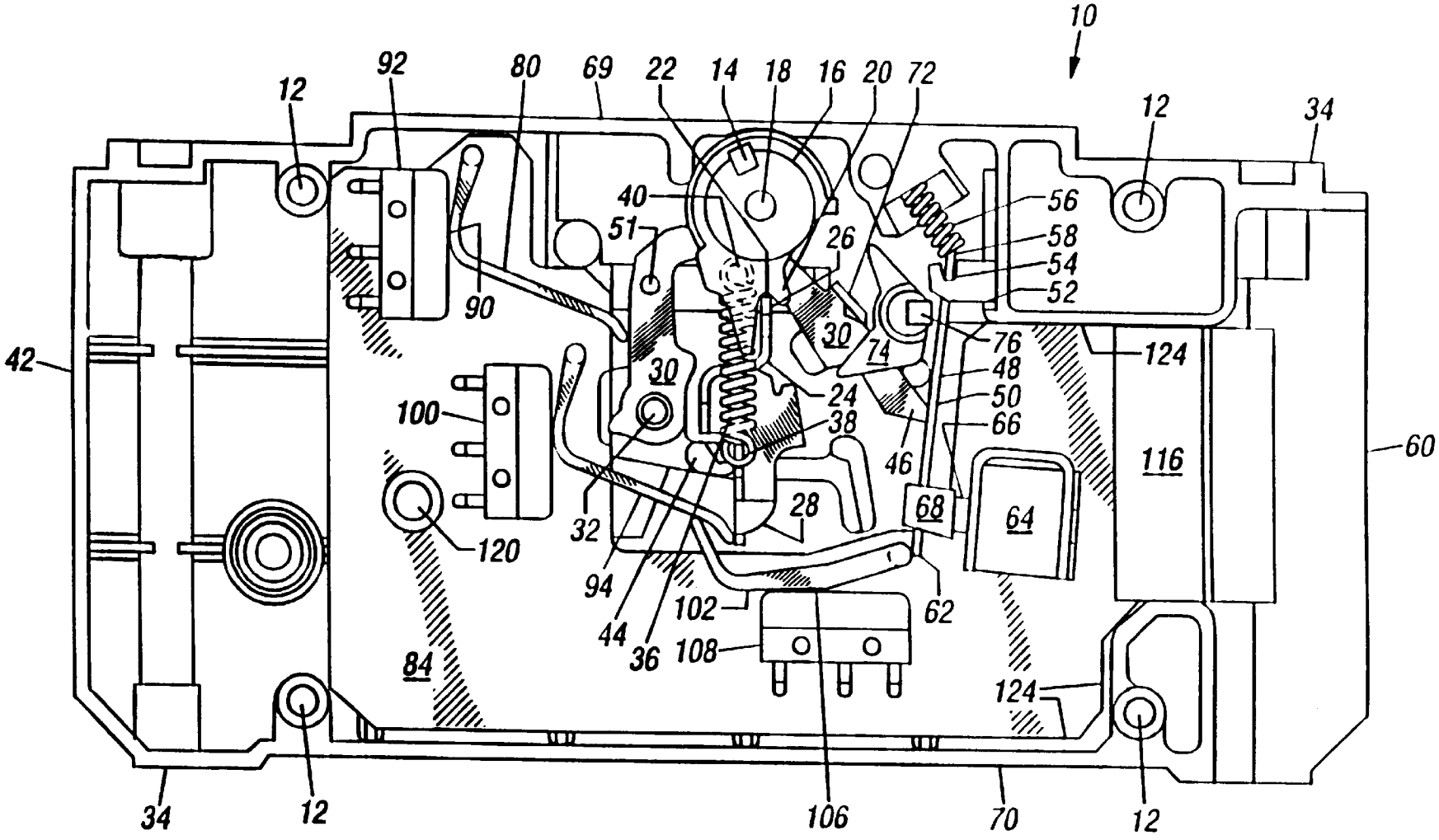
FIG. 2 shows a plan view of the accessory module of FIG. 1 with its mechanism in a first position.
Figure 2A:
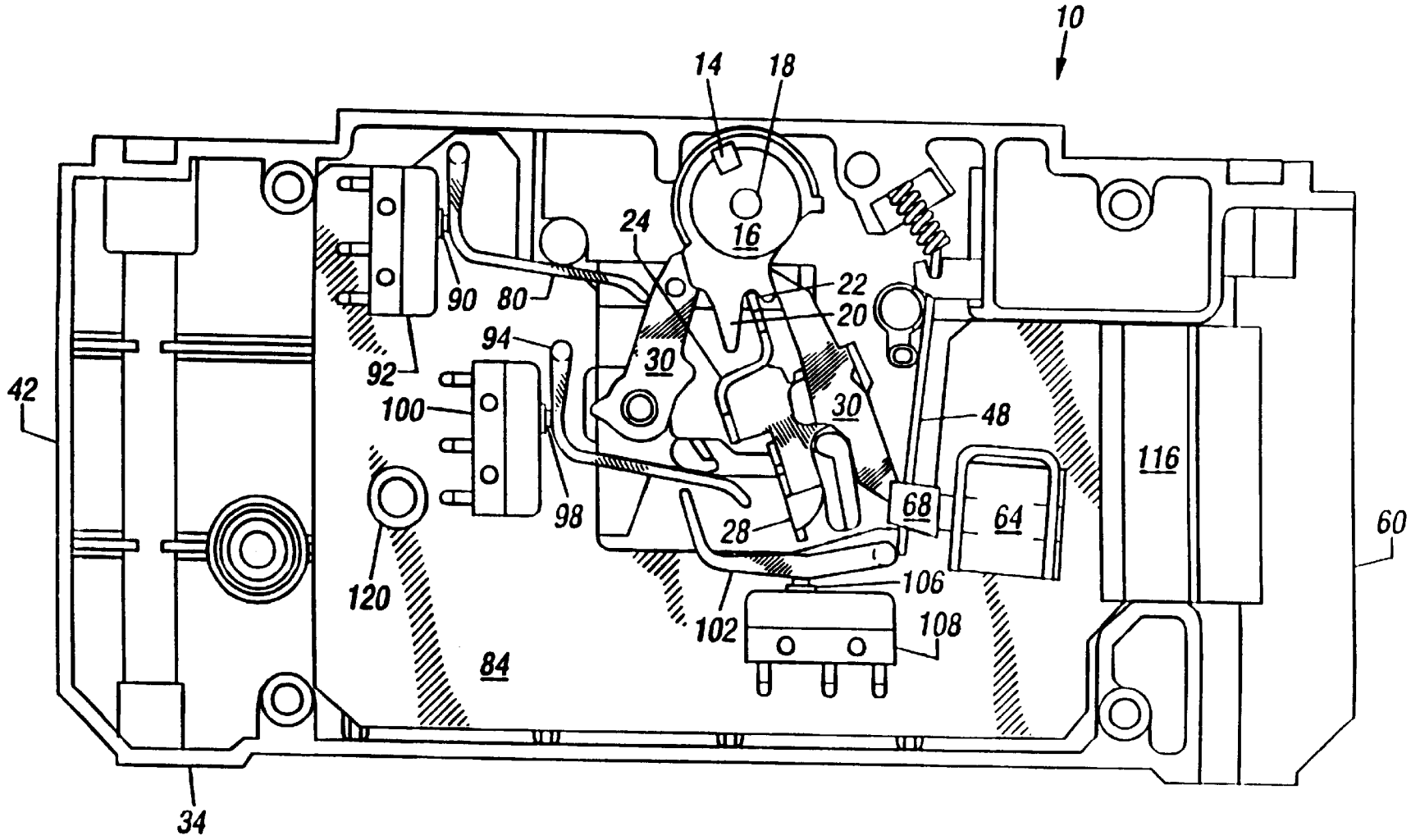
FIG. 2A shows the accessory module of FIG. 1 with its internal mechanism in a second position.

Turning now to the drawings, FIG. 1 shows an isometric view of an accessory module 10 without its cover. FIG. 2 shows a plan view of the accessory module 10 of FIG. 1. FIG. 2A shows the accessory module 10 with its internal mechanism in a second position. The accessory module 10 having its cover (not shown) is attached to the side of a circuit breaker (not shown) by screws, rivets or similar means through holes 12. A shaft or crossbar (not shown) extends from the switch handle of the circuit breaker into a hole 14 in a dummy handle 16 of the accessory module 10. By this shaft the position of the switch handle in the circuit breaker is imitated by the dummy handle 16 in the accessory module 10. The hole 14 is illustrated as square in shape, although other shapes may be used. However, the shaft should not pivot in the hole 14, but rather should rotate the dummy handle about a pair of pivots 18. (The second pivot is not shown, but is located on the opposite face of the dummy handle 16.)

The dummy handle 16 has a forked projection 20 which has a bearing surface 22. The bearing surface 22 is a cam with respect to the dummy handle 16. An actuator blade 24 pivots in the bearing surface 22. The actuator blade 24 has a pivot end 26 that pivots in the bearing surface 22 and a free end 28. A trip lever 30 rotates on a pivot 32 that is molded into a base 34. A mechanism spring 36 is attached at one end to a hook 38 on the actuator blade 24 and at its other end to a hook 40 on the trip lever 30. The hook 40 is shown as a hidden line below the forked projection 20 in FIG. 2. Rotation of the dummy handle 16 causes the free end 28 of the actuator blade 24 to move from a first position illustrated in FIG. 2 laterally to a second position illustrated in FIG. 2A.

The first position of the free end 28 of the actuator blade 24, which is illustrated in FIG. 2, occurs when the switch handle of the attached circuit breaker is in its "on" position, meaning that a circuit path is established between a source and a load through the circuit breaker. The second position of the free end 28 of the actuator blade 24, which is illustrated in FIG. 2A, occurs when the switch handle of the attached circuit breaker is in its "off" or "trip" position, meaning that a circuit path between the source and the load through the circuit breaker is open. Tension can be put on the mechanism spring 36 to store energy in the spring 36. This stored energy will be discussed more fully below, but it is used to drive the mechanical action that occurs when the circuit breaker switch handle moves to the "trip" position.

A force is transmitted from the circuit breaker switch handle through a shaft or crossbar (not shown) which is normally positioned in the hole 14 of the dummy handle 16. The circuit breaker switch handle is similar to the dummy handle 16, but has a lever that extends outward from the body of the handle for manual operation. The crossbar has one end in the hole 14 and an opposing end in a similar hole in the switch handle. Rotation of the switch handle in the circuit breaker causes the dummy handle 16 to rotate, since the two are linked by the crossbar.

The bearing surface 22 on the forked projections 20 moves in a cam-like motion, which is both lateral and reciprocating. The pivot end 26 of the actuator blade 24 is pressed into the bearing surface 22 by the tension on the mechanism spring 36. With the dummy handle 16 in the position shown in FIGS. 1 and 2, the tension on the spring 36 tends to pull the free end 28 of the actuator bar 24 toward the left side 42 of the base 34. A stop 44 is molded into the base 34, which stops the free end 28 of the actuator bar 24 from moving further to a left 42. Rotation of the handle 16 moves the bearing surface 22 and the pivot end 26 of the actuator blade 24. Rotation causes a realignment of the spring 36 which causes the end 28 of the actuator blade 24 to swing to the second position illustrated in FIG. 2A. This realignment of the spring 36 is called over-toggling.

The trip lever 30 is in a latched position with the spring 36 in tension, while in the position shown in FIGS. 1, and 2. An armature blade 48 has a slot 50 which receives a tip of a free end 46 of the trip lever 30. A pin 51 in the trip lever 30 engages the projection 20 to latch the trip lever 30 when the handle 16 is rotated. A bearing bracket 52 is secured in the base 34 and has bearing notches 54. One end of the armature blade 48 is notched to engage with and pivot on the bearing notches 54. An armature spring 56 is normally under a compressive force which pushes a pivot end 58 of the armature blade 48 toward a right side 60 of the base 34. Pushing the pivot end 58 to the right 60 causes a free end 62 of the armature blade 48 to move toward the left side 42. Thus, the compressive force of the armature spring 56 presses the free end 62 to the left 42. This force keeps the free end 46 of the trip lever 30 engaged in the slot 50 in the armature blade 48. The trip lever 30 stays in this stable position until the free end 62 of the armature blade 48 is forced to the right 60.

The armature blade 48 can be forced to the right 60 by a solenoid, a shunt trip coil 64. The shunt trip coil 64 has a plunger 66 which is connected to the free end 62 of the armature blade 48 by a trip link 68. The plunger 66 has a groove around its circumference and the trip link 68 has a cooperating slot that engages the groove, connecting the plunger 66 to the trip link 68 for lateral movement between left 42 and right 60. The trip link 68 has an inverted "U" shape that cooperatively fits over the free end 62 of the armature blade 48. The various mechanical parts that cooperate, including the dummy handle 16, actuator blade 24, trip lever 30, mechanism spring 36, armature blade 48, and armature spring 56, are referred to hereafter as a mechanism 69.

When the shunt trip coil 64 is energized, the plunger 66 is pulled into the coil 64. The movement of the plunger 66 to the right 60 pulls the free end 62 of the armature blade 48 to the right 60. The movement of the armature blade 48 to the right 60 causes the free end 46 of the trip lever 30 to slide out of the slot 50 in the armature blade 48. The stored tension energy in the mechanism spring 36 pulls the free end 46 of the trip lever 30 towards a bottom side 70 of the base 34. The trip lever 30 rotates on its pivot 32. The trip lever 30 is shaped such that the spring hook 40 moves toward the right 60 when the free end 46 is disengaged from the slot 50. The lateral movement of the spring hook 40 toward the right 60 changes the alignment of the spring 36, causing the free end 28 of the actuator blade 24 to move laterally to the right 60. Thus, the actuator blade end 28 moves into its second position after the shunt trip coil 64 is energized.

The second position of the actuator blade 24 is illustrated in FIG. 2A, and the delatched position of the trip lever 30 is illustrated. The mechanism spring 36 has been omitted for clarity. The difference is that in the delatched position the end 46 of the trip lever 30 is moved toward the bottom side 70 and the end 46 is not engaged in the slot 50. Near its pivot 32, the trip lever 30 has a lateral movement to the right 60 when the end 46 is suddenly delatched. As discussed below, this movement is monitored and detected.

The shunt trip coil 64 can be energized by a remote electrical signal. This causes the response described above and trips the adjoined circuit breaker. The trip lever 30 has an ear 72 which contacts and rotates a trip cam 74 when the trip lever end 46 becomes disengaged from the slot 50. The trip cam 74 has a hole 76, similar to the hole 14 in the dummy handle 16. A trip crossbar or shaft (not shown) extends from the hole 76 to a similar hole in a similar trip cam in the adjacent circuit breaker (not shown). To effect the rotation of the trip cam in the circuit breaker, the trip cam 74 and its crossbar are preferably square because this shape transmits torque to the adjoining trip cam rather than pivoting. A remote signal can be used to energize the shunt trip coil and, consequently, trip the circuit breaker. After such a trip the mechanism would remain in this state until the attached circuit breaker is reset to its "on" position.

The trip cam 74 also works to trip the accessory module 10 when the adjoining circuit breaker is tripped. If the circuit breaker experiences an abnormal condition that causes it to trip, then the trip crossbar rotates the trip cam 74, which moves the armature blade to the right 60. This delatches the end 46 from the slot 50 in the armature blade 48.

The end 28 of the actuator blade 24 is moved toward the right 60 whenever the circuit breaker contacts are open. If the handle 16 is rotated to the "off" position, the spring 36 is over-toggled, and the end 28 is snapped to the right 60. If the circuit breaker handle is in the "on" position, but is then moved to the "tripped" position, the trip lever 30 is delatched and the movement of the hook 40 on the trip lever 30 over-toggles the spring 36, causing the end 28 to be snapped to the right 60. The end 28 is toward the right whenever the circuit breaker contacts are open.

With the operation of the mechanism 69 thus explained, consider now how the physical position of the mechanism 69 is detected and that signal transmitted. As best seen in FIG. 2, the trip lever 30 contacts a first actuator 80 when the mechanism 69 is in the latched position illustrated in FIG. 2. With reference to FIG. 3, the first actuator 80 has a pivot 82 that snaps into a hole 83 in a printed circuit board 84. As best seen in FIG. 4, the pivot 82 is a pin with a longitudinal slot 86 and barbs 88. The actuator 80 rotates about the pivot 82. As best seen in FIG. 2A, the actuator 80 contacts a button 90 on an alarm switch 92, sometimes referred to as a bell alarm switch. When the mechanism 69 is in the latched position illustrated in FIG. 2, the trip lever 30 presses on the actuator 80, which rotates about its pivot 82, and depresses the button 90. When the trip lever end 46 is disengaged from the slot 50, the trip lever 30 moves to the right 60, which allows the button 90 to protrude to its fullest extent. In this manner the alarm switch 92 detects the position of the trip lever 30, which indicates the status of the adjacent circuit breaker, i.e. whether the circuit breaker is tripped. Thus, the trip status of the adjacent circuit breaker can be inferred from the status of the alarm switch 92. The status of the alarm switch 92 can be indicated in a remote control center.

A second actuator 94 is essentially identical to the first actuator 80. The first and second actuators 80, 94 are designed to be interchangeable, thus reducing the number of parts required for the accessory module 10. The second actuator 94 rotates about a pivot 96 which snaps into a hole 97. The actuator 94 contacts a button 98 on a shunt clearing switch 100. When the mechanism 69 is in the latched and "on" position illustrated in FIG. 2, the free end 28 of the actuator blade 24 presses or forces the actuator 94 to the left 42.

A third actuator 102 is strategically located so that movement of the second actuator 94 is also transmitted to the third actuator 102. The third actuator 102 rotates about a pivot 104 and engages a third button 106 in an auxiliary switch 108. The buttons 98, 106 can be either depressed or extended while the button 90 is depressed. If the button 90 is extended outward, then the trip lever 30 is in its tripped or delatched position, which moves the end 28 to the right 60, releasing the buttons 98, 106. If the button 90 is out, then necessarily, the other two buttons are out. The buttons 98, 106 can be either in or out while the button 90 is in. As described above, when the trip lever 30 is disengaged from the armature blade 48, the free end 28 of the actuator blade 24 moves laterally to the right 60. This removes the force that was applied to the second actuator 94, which, in turn, removes the force that the second actuator 94 applied to the third actuator 102. The three buttons 90, 98, 106 are spring loaded so that when the force holding the actuators 80, 94, 102 is removed, the buttons 90, 98, 106 extend to their fullest outward position.

The clearing switch 100 normally completes a circuit path when the adjacent circuit breaker is not tripped and its contacts are closed, completing its circuit path. The clearing switch 100 is in a circuit path with the shunt trip coil 64. If the shunt trip coil 64 is energized, the mechanism 69 and the adjacent circuit breaker are both tripped. This opens the clearing switch 100 and de-energizes the shunt trip coil 64, since that circuit path is broken when the button 98 is released. The clearing switch allows the coil 64 to reset to its normal deactivated state.

The auxiliary switch 108 can be used to infer whether the adjoining circuit breaker is in its "on" or "off" or "tripped" position. The position of the end 28 mimics the position of a movable contact in the adjoining circuit breaker. When the movable contact in the adjoining circuit breaker is toward the left 42, it contacts a stationary contact and establishes a circuit path. When the movable contact in the adjoining circuit breaker is toward the right 60, it does not contact the stationary contact, which breaks its circuit path. Thus, from the position of the end 28, the position of the movable contact in the adjoining circuit breaker can be inferred. The position of the end 28 is sensed by the auxiliary switch 108 through the actuators 94 and 102. The state of the auxiliary switch 108 is therefore correlated to the status of the adjoining circuit breaker. The state or status of the auxiliary switch 108 can be monitored from a remote control center, and the status of the adjoining circuit breaker can be inferred therefrom. Further, the status of the alarm switch 92 and the status of the auxiliary switch 108 can be interpreted together to infer the status of the adjoining of the adjoining circuit breaker.

Consider now the actuators 80, 94, 102, which are made of a flexible and resilient material, typically a thermoplastic. The design of the actuators offers many advantages. The material is sufficiently stiff to ensure activation, yet flexible enough to prevent over-actuation that would damage the switches 92, 100, 108. Over-actuation could otherwise result because the mating parts are made of high strength material. The design of the pivots 82, 96, 104 with the slot 86 provides compressibility, allowing them to directly engage the circuit board 84. Thus, a separate mechanical fastener is not needed to fasten the actuators 80, 94, 102 to the circuit board 84. The ends of the pivots 82, 96, 104 are compressed during insertion of a pivot into the aligning hole in the circuit board. The barb or hook on the end of a pivot slides through the opening in the circuit board because the slot 86 allows it to be compressed. The resiliency of the material causes the pivot pin to expand back to its normal size. The barbs or hooks engage the circuit board and prevent the pivots from backing out.

The shape of the actuators 80, 94, 102 somewhat resembles an "L" shape. The shape, location of the pivots 82, 96, 104, and point of contact with the mechanism 69 were all designed to transform or scale down the large movement of the mechanism parts, the trip lever 30 and the blade actuator 24, to a small movement required for the for the switch buttons 90, 98, 106. The circuit board 84 was particularly designed to fit in the base 34 and provide a surface for mounting the switches 92, 100, 108 and actuator pivots 82, 96, 104. Utilizing two identical actuators 80, 94 in different locations in a confined space was accomplished in the design by strategically placing the switches 92, 100, 108 on the circuit board 84.

The thermoplastic actuators 80, 94, 102 act as a link between the mechanism 69 and the switches 92, 100, 108. The flexibility of the actuators eliminate the need to hold tight positional tolerances on the switches or the actuators. The snap-in feature of the pivots 82, 96, 104 eliminate the need for rivets or screws. When the mechanism 69 is latched, as shown in FIG. 2, one set of signals or information is conveyed to the switches 92, 100, 108 through the actuators 80, 94, 102. When the mechanism 69 is tripped, a different set of signals or information is conveyed to the switches 92, 100, 108 through the actuators 80, 94, 102.

Figure 5:
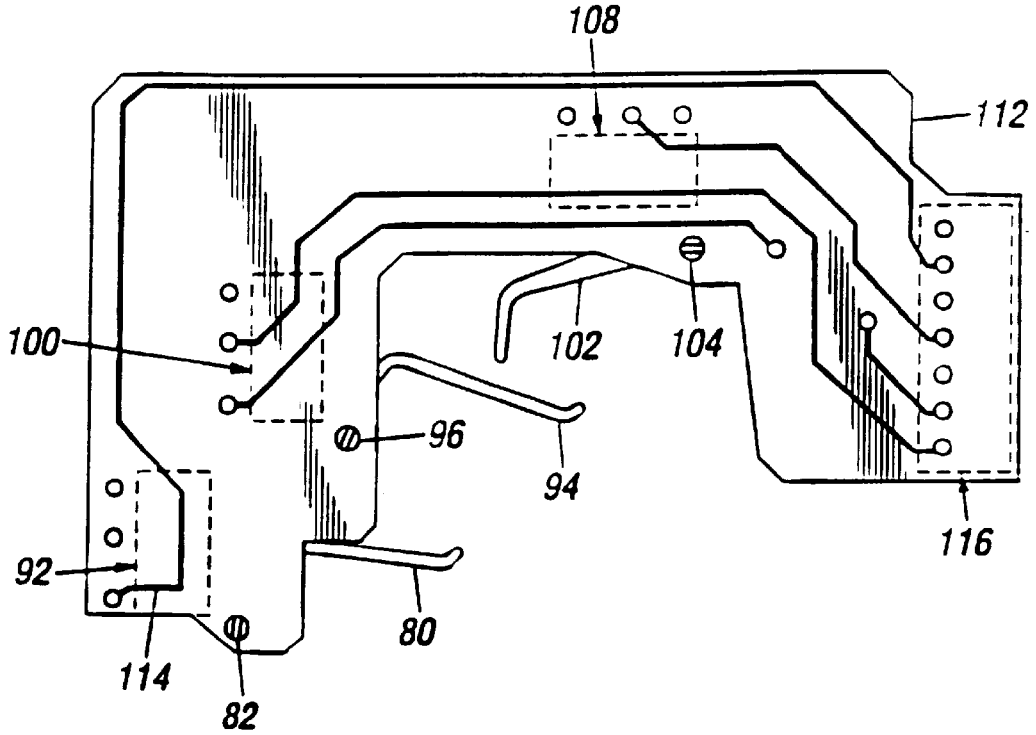
FIG. 5 shows a plan view of a circuit board, according to the present invention.

Turning now to the accessory circuit board 84, an isometric view of its top 110 is provided in FIG. 3 and a plan view of its bottom 112 is provided in FIG. 5. The circuit board 84 serves as a locator of moving parts that pivot in the board and actuate the switches. Electrically conductive foil traces 114 are provided on both the top 110 and the bottom 112. All current carrying aspects of the accessory module 10 are incorporated into the circuit board 84, its traces 114, the switches 92, 100, 108, the coil 64, and a mounted seven-pin connector 116. The connector 116 provides a receptacle for a terminal plug 126 (discussed below) for communication of signals with a remote site. The traces 114 eliminate the need for wires connecting the switches 92, 100, 108. Wires are typically hand soldered at their connections, while the traces 114 are machine made and tend to be of higher quality. The machine made traces 114 can be produced for lower cost than hand-soldered wiring.

Some of the foil traces 114 have been sized and positioned to attain an unusually high current rating for a printed circuit board, and the auxiliary switch 108 is also designed for an unusually high current rating as well. The traces 114 for the auxiliary switch 108 have a maximum 13 ampere rating. The traces 114 are located both on the top 110 and the bottom 112 of the circuit board 84. The circuit board 84 is mounted in the base 34 and in the mating cover (not shown) with a clearance between the traces 114 and the interior surfaces of the base 34 and cover. The thickness of the board is sized for proper insulation between the top 110 and bottom 112 traces 114 and for proper positioning of cooperating parts between the mechanism 69 and the actuators 80, 94, 102.

The circuit board 84 is positioned in the base 34 by the mating of a hole 118 in the circuit board 84 about a post 120 on the base 34, as best illustrated in FIGS. 1 and 3. The edges 122 of the circuit board 84 are designed to act as limiters which orient the board 84 within walls 124 of the base 34. In this manner the circuit board 84 is firmly positioned in the base 34 and sufficiently secured to detect movement of the mechanism 69.

The switches 92, 100, 108 are mounted on the board 84 at a right angle to the board 84. As best seen in FIG. 5, each switch 92, 100, 108 has three pin connectors, but all three are not necessarily used. The alarm switch 92 activates when the trip lever 30 is delatched from the armature blade 48 by shunt tripping or the rotation of the trip crossbar. The alarm switch 92 monitors whether the mechanism 69 is in a tripped position. Thus, it detects an abnormal condition, which may be due to a current overload. This status is communicated to a remote site by current through the traces 114 to the connector 116 which connects with a terminal plug. The alarm switch 92 can activate an alarm in a remote control center when the adjoining circuit breaker is tripped.

The clearing switch 100 deactivates the shunt trip coil 64 after its has been activated. A trace 114 connects one pin of the second switch 100 to a pin from the shunt trip coil 64. Under normal conditions, the attached circuit breaker would have its contacts closed making a circuit. In this normal condition the mechanism 69 would be in the position illustrated in FIG. 2, and the button 98 on switch 100 would be depressed. With the button 98 depressed, a circuit is made with the shunt trip coil 64, but in this normal condition, the circuit is deactivated. A remote signal can energize the coil 64 through this circuit, which causes the trip lever 30 to delatch, allowing the button 98 to open outward. When the button 98 projects outward, the circuit with the coil 64 is opened, deactivating the coil 64.

The auxiliary switch 108 monitors whether the circuit breaker contacts are open or closed. The auxiliary switch 108 detects whether the associated circuit breaker is in its "on" or "off" position. This switch 108 is more than merely a toggle switch having two positions, and all three of its pins are used. The auxiliary switch 108 on/off status is based on the blade end 28 position which is controlled by the handle position of the circuit breaker. A shunt trip circuit is deactivated by the clearing switch 100 based on the blade end 28 position, where "on" indicates activation and "off"indicates deactivation. The traces 114 provide circuit paths between the switches 92, 100, 108, the coil 64, and the connector 116.

Figure 6:
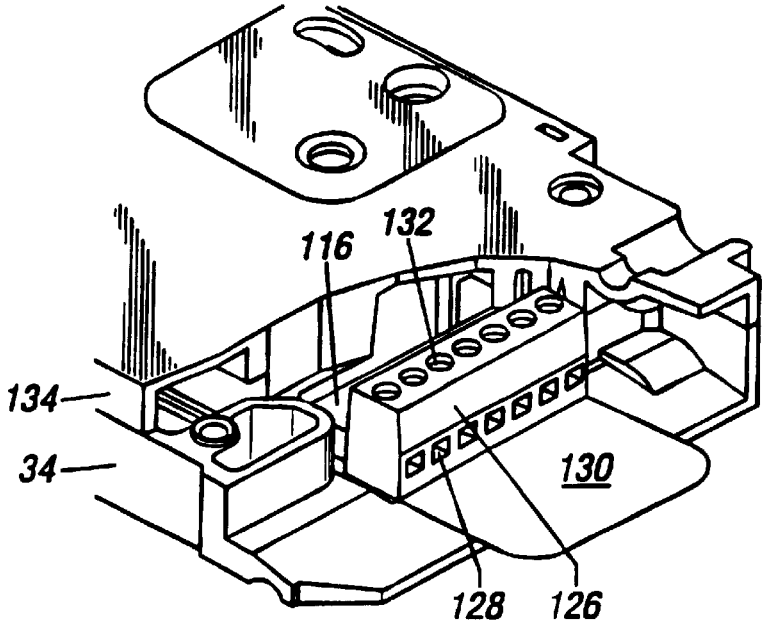
FIG. 6 shows a terminal plug engaged with an accessory module, according to the present invention.
Figure 7:
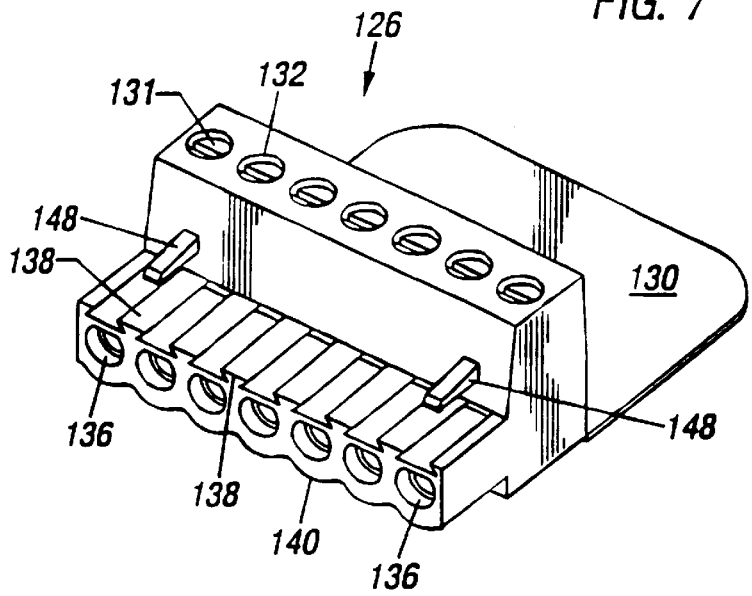
FIG. 7 shows the terminal plug of FIG. 6 removed from the accessory module.

With reference to FIGS. 6 and 7, a terminal plug 126 engages with the connector 116. The terminal plug 126 has seven slots 128 for receiving wires from a remote site. The terminal plug 126 has a pull tab 130 adhered to it. An installer can grasp the pull tab 130 and pull the terminal plug 126 out of the accessory module 10. This disconnects the terminal plug 126 from the connector 116. The installer can insert wire ends into the slots 128 and tighten lugs 131 in the holes 132. A cover 134 covers the base 34, which makes the terminal plug inaccessible. Without the pull tab 130, field installation of wires into the plug 126 would be impractical because the cover 134 would have to be taken off the base 34 in order to access the plug 126. The pull tab 130 is a sheet of strong, flexible plastic material having an adhesive coating on one side and a removable paper sheet covering the adhesive. The paper is scored near one end for removal of a minor portion of the paper when assembling the pull tab 130 onto the terminal plug 126. A major portion of the paper is left adhered to the plastic sheet.

As seen best in FIG. 7, the plug 126 has female connectors 136 that mate with male connector pins in the connector 116. With the wires installed, the plug 126 can be inserted into the connector 116. The plug 126 cannot be inserted wrongly, because there is only one position where the connector 116 will engage with the plug 126. This functionality is provided by raised surfaces 138 and a rounded or sculpted bottom portion 140 of the plug 126.

Figure 8:
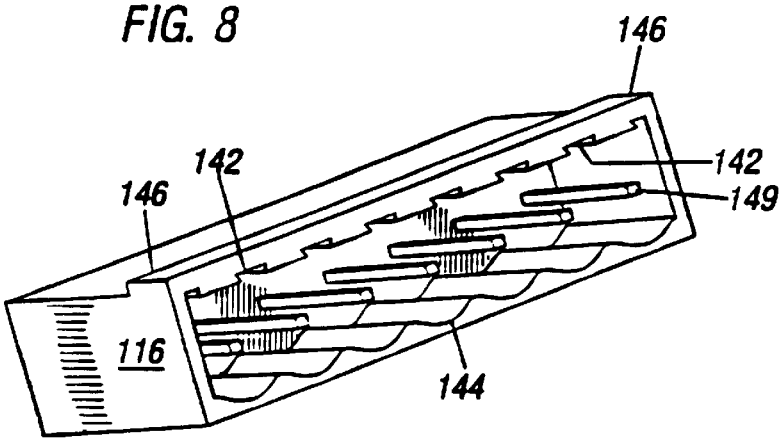
FIG. 8 shows an isometric view of a connector, according to the present invention.
Figure 9:
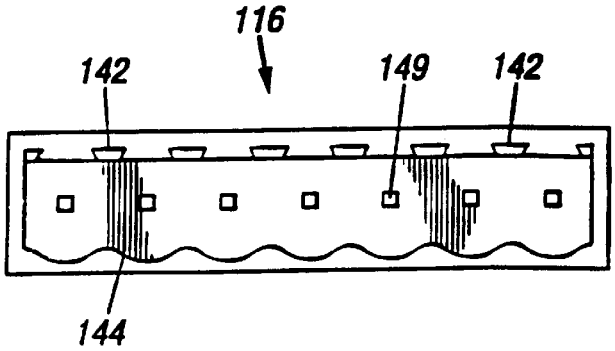
FIG. 9 shows an end view of the connector of FIG. 8.

FIG. 8 shows an isometric view of the connector 116, and FIG. 9 shows an end view of the connector 116. The connector 116 has receiving slots 142 for mating with the surfaces 138 in the plug 126. The connector 116 also has a rounded or sculpted bottom 144 for mating with the rounded or sculpted bottom 140 of the plug 126. As shown in FIG. 8, the connector 116 has a shoulder 146, and the plug 126 has extending clips 148. When the plug 126 is inserted into the connector 116, the clips 148 engage the shoulder 146, holding the plug 126 and the connector 116 together in a locked position. Connector pins 149 are also illustrated in FIGS. 8 and 9.

Thus, the accessory terminal plug 126 provides a means of connecting the internal accessory components with an external, user-defined circuit, and allows easy installation of wire leads by removal of the plug 126 from the accessory module 10. The plug 126 and pull tab 130 eliminate the need for pigtails or wire leads to be shipped with the accessory module 10 and the cost and quality problems associated with soldering lead wires for later field connection. The combination of the connector 116, terminal plug 126, and pull tab 130 is adaptable to other devices or enclosures where the flexibility and convenience of removing the plug for wire installation is advantageous.

Figure 10:
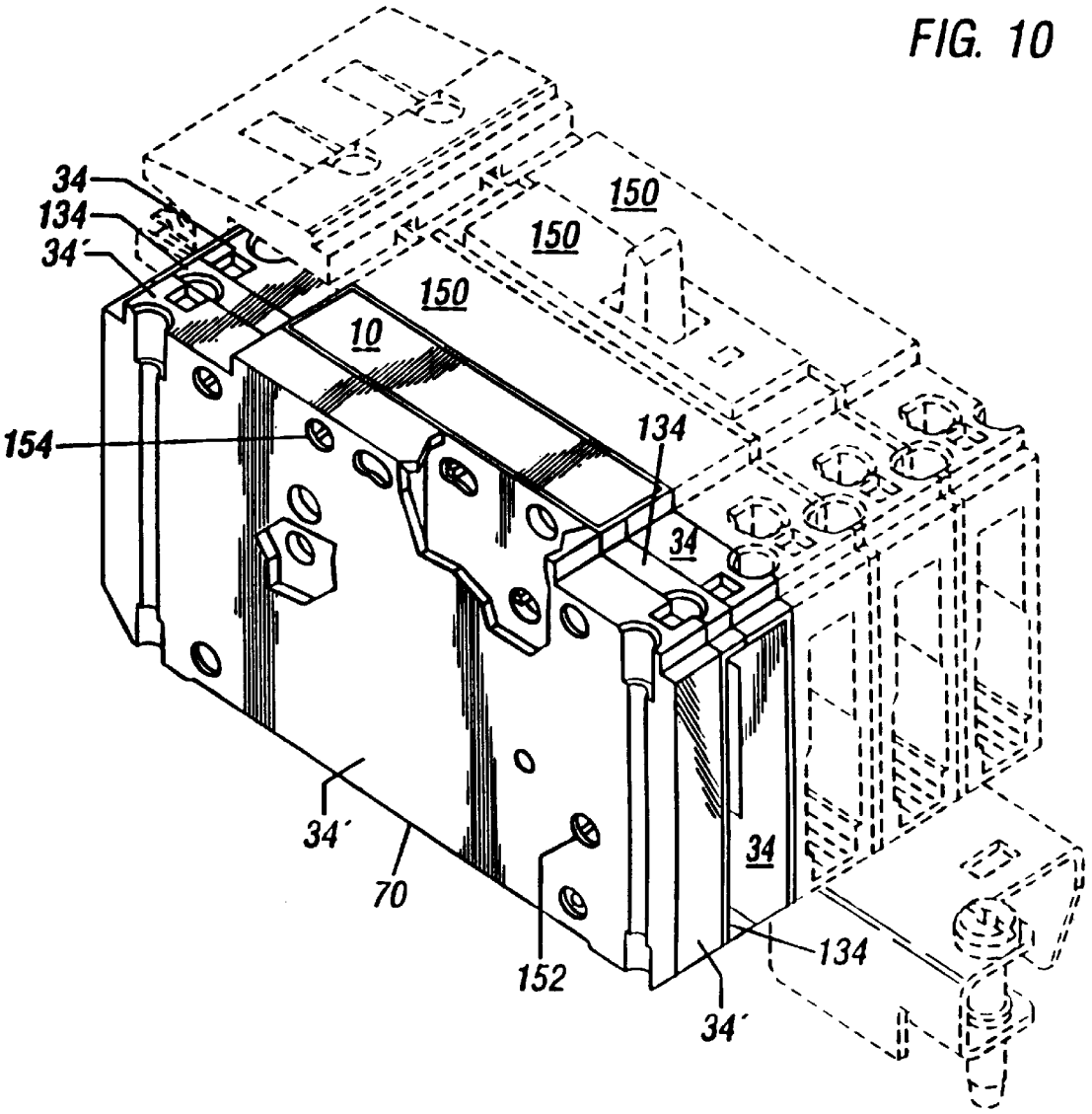
FIG. 10 shows an accessory module connected to a circuit breaker, and illustrates the use of a base as a spacer.

Turning now to another aspect of the present invention, FIG. 10 illustrates the multifunctionality of the base 34. For some installations of an accessory module 10 (in an I-Line panelboard, for example), a spacer is required to adapt the width of the circuit breaker and the accessory module 10 to the requirements of the panel. The base 34 has been designed to function both as a casing for the mechanism 69, circuit board 84, etc. and as a spacer. The use of the base 34 as a casing has been illustrated throughout the discussion above. However, the base 34 can be flipped over and used as a spacer. As a spacer, the base 34 adapts the assembly to the requirements of the panel.

With reference to FIG. 10, a base 34' can be mounted to the cover 134 of an accessory module 10. The accessory module 10 comprises a base 34, holding and locating the mechanism 69, the circuit board 84, and other internal accessories, and a cover 134. The mounting holes in the base 34 are positioned to allow for a screw to fasten the cover 134 and base 34 to a circuit breaker 150 via through-holes in the base 34, 34'. The bottom side 70 of the base has one through-hole 152 countersunk for a screw to be used to attach the flipped-over base 34' to the cover 134. An additional countersunk through-hole 154 is required in the base 34, 34' to complete the spacer installation. A total of three holes exist in the base 34, 34'. Two of the holes 152, 154 are countersunk on the flat bottom-side to allow for the dual functioning of the base 34, 34'. Use of the base 34 as a spacer 34' reduces the overall number of parts required to furnish the circuit breaker 150 with an accessory module 10.

In summary, the invention provides an accessory module 10 having an assembly 69 of various mechanical parts that cooperate to mimic the operation of similar parts in a circuit breaker. Like a circuit breaker, the accessory module 10 has a handle 16, a trip lever 30, a movable contact point 28 on an actuator blade 24, a mechanism spring 36, and an armature 48. Actuators 80, 94, 102 sense, monitor, and detect the position of the trip lever 30 and the blade contact end 28. The actuators transfer the motions of the mechanical assembly 69, particularly the trip lever 30 and the blade contact end 28, to switches 92, 100, 108 which transform the movement into electrical signals by either making or breaking a circuit. A circuit board 84 is especially designed to hold and locate the switches and provide tracings that can withstand high currents. A terminal plug 126 provides a convenient and useful means for field installation of wires for connection of the accessory module 10. In some applications a spacer is required for the accessory module 10, and the base 34 has been designed to function in a dual capacity as a base 34 and as a spacer 34'.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A terminal plug for connecting an inaccessible connector on a device, said inaccessible connector having a plurality of first sculpted surface at one side of said connector for receiving the terminal plug, the terminal plug having:

(a) a body;

(b) a plurality of lugs in the body adapted to receive wires, the lugs being adapted to be tightened;

(c) a plurality of receptacles in the body electrically conductively connected to the plurality of lugs for connection with the connector;

(d) a pull tab fixed to the body for pulling the terminal plug out of the connector; and (e) a plurality of second sculpted surface adapted to mate with the first sculpted surface of said connector.

2. The terminal plug of claim 1, wherein the body has a fastener projecting therefrom for securing the terminal plug to the connector.

3. A terminal plug for attachment to a connector having a first rounded surface for an accessory module for a circuit breaker, the terminal plug having:

(a) a body having a second rounded surface adapted for mating with the first rounded surface, and a plurality of lugs in the body adapted to receive wires and adapted to be tightened;

(b) a plurality of receptacles in the body, each being electrically conductively connected to a lug, for connection with the connector; and (c) a pull tab fixed to the body for pulling the terminal plug out of the connector.

4. The terminal plug of claim 3, wherein the body has a fastener projecting therefrom for securing the terminal plug to the connector.

5. The terminal plug of claim 3, wherein the pull tab is flexible.

6. The terminal plug of claim 5, wherein the pull tab comprises:

(a) a first sheet, the first sheet having an outside surface and an inside surface;

(b) an adhesive on the inside surface; and (c) a second sheet removably secured to the adhesive, wherein the second sheet is scored for removal of part of the second sheet during assembly of the accessory module.

7. The terminal plug of claim 6, wherein the accessory module has a casing, the terminal plug and connector are enclosed within the casing, and the pull tab extends outside the casing.

8. The terminal plug of claim 1, wherein the pull tab is a sheet.

9. The terminal plug of claim 1, wherein the pull tab is flexible.

* * * * *